United States Patent [19]

Pawelzik et al.

[11] Patent Number: 5,056,562

[45] Date of Patent: Oct. 15, 1991

[54] CONVERTIBLE FAUCET/HAND-SHOWER FITTING

[75] Inventors: Manfred Pawelzik, Soost; Rudolf Haufe, Menden, both of Fed. Rep. of Germany

[73] Assignee: Friedrich Grohe Armaturenfabrik GmbH & Co., Hemer, Fed. Rep. of Germany

[21] Appl. No.: 491,665

[22] Filed: Mar. 9, 1990

[30] Foreign Application Priority Data

Mar. 10, 1989 [DE] Fed. Rep. of Germany ..... 3907894

[51] Int. Cl.[5] ..... E03C 1/04; F16K 11/00

[52] U.S. Cl. ..... 137/801; 4/191; 4/192; 4/615; 239/283; 239/588

[58] Field of Search ..... 4/191, 192, 615; 137/801; 239/282, 283, 525, 588; 285/371

[56] References Cited

U.S. PATENT DOCUMENTS

| | | | |
|---|---|---|---|
| 4,674,687 | 6/1987 | Smith et al. | 239/525 X |
| 4,719,654 | 1/1988 | Blessing | 4/615 X |
| 4,964,573 | 10/1990 | Lipski | 4/615 X |

FOREIGN PATENT DOCUMENTS

| | | | |
|---|---|---|---|
| 1732891 | 10/1956 | Fed. Rep. of Germany . | |
| 3135860 | 3/1983 | Fed. Rep. of Germany | 4/615 |
| 3726788 | 2/1989 | Fed. Rep. of Germany | 4/615 |

*Primary Examiner*—Gerald A. Michalsky

*Attorney, Agent, or Firm*—Herbert Dubno; Andrew Wilford

[57] ABSTRACT

A plumbing fitting has a flexible hose suppliable with water under pressure and having an outer end, an upstream end piece having an upstream side connected to the outer end and a downstream side, and a downstream end piece having a downstream side and an upstream side. An outer sleeve has an upstream end and a downstream end and respective couplings releasably connect the upstream end of the sleeve to the downstream side of the upstream end piece and the downstream end of the sleeve to the upstream side of the downstream end piece. An inner tube having a downstream end connected to the upstream side of the downstream end piece and an upstream end connected to the downstream side of the upstream end piece forms a flow conduit therebetween. Seals are provided at the ends of the tube between same and the respective sides of the end pieces.

10 Claims, 3 Drawing Sheets

CONVERTIBLE FAUCET/HAND-SHOWER FITTING

FIELD OF THE INVENTION

The present invention relates to a faucet. More particularly this invention concerns such a fitting which can be used also as a hand sprayer or shower.

BACKGROUND OF THE INVENTION

A plumbing fitting is known having a hand-held part that is mounted at the outer end of a hose whose inner end is connected to a wall- or counter-mounted mixing valve. The hand-held part has an upstream end piece connected to the hose and a downstream end piece carrying a flow dispenser, either a shower or an aerator depending on use. Such an arrangement is useful as a combination bath fitting, as a sink fitting where it serves both as faucet and spray, and in a hairdressing salon where it is used, typically as a deck mount, at the shampoo sink.

German utility model 1,732,891 describes such a fitting where the hand-held part is basically formed as a decorative synthetic-resin handle having an elbow at one end connected to the hose and an elbow at the opposite end provided with the flow dispenser. These elbows are threaded directly onto the center part formed by the handle.

Such an arrangement leaves little possibility of adjustment or variation. Swapping out the center part does allow one to vary the length and color of it, but is fairly expensive in that the center part is a structural element that must be solidly constructed and intricately machined.

OBJECTS OF THE INVENTION

It is therefore a object of the present invention to provide an improved plumbing fitting.

Another object is the provision of such an improved plumbing fitting which overcomes the above-given disadvantages, that is which can be used as a faucet or shower/spray, and that is of simple but highly adaptable construction.

SUMMARY OF THE INVENTION

A plumbing fitting according to this invention has a flexible hose suppliable with water under pressure and having an outer end, an upstream end piece having an upstream side connected to the outer end and a downstream side, and a downstream end piece having a downstream side and an upstream side. An outer sleeve has an upstream end and a downstream end and respective couplings releasably connect the upstream end of the sleeve to the downstream side of the upstream end piece and the downstream end of the sleeve to the upstream side of the downstream end piece. An inner tube having a downstream end connected to the upstream side of the downstream end piece and an upstream end connected to the downstream side of the upstream end piece forms a flow conduit therebetween. Seals are provided at the ends of the tube between same and the respective sides of the end pieces.

Thus with the system of this invention the sleeve serves principally a decorative function so that it can be made of a colored or inexpensive material, like a plastic. The inside tube itself conducts water through the fitting, so that it alone need be ruggedly built. This makes it possible to vary the appearance and length of the fitting fairly easily.

According to further features of this invention the end pieces are elbows with their respective ends opening generally right angles to each other. In addition the sleeve is generally tubular and the couplings include at least one bayonet coupling. The tube is of metal, preferably brass, and the sleeve is of a synthetic resin. The outer ends of the end pieces are elbows with their respective ends open generally at right angles to each other and the upstream end of the upstream end piece opens in the same direction as the downstream end of the downstream end piece.

The fitting according to this invention is carried on a bracket forming a holder for the upstream end piece. This bracket can be part of the water-supplying mixing valve. The downstream side of the downstream end piece is provided with an aerator.

DESCRIPTION OF THE DRAWING

The above and other objects, features, and advantages will become more readily apparent from the following, reference being made to the accompanying drawing in which.

SPECIFIC DESCRIPTION

Figure 1:
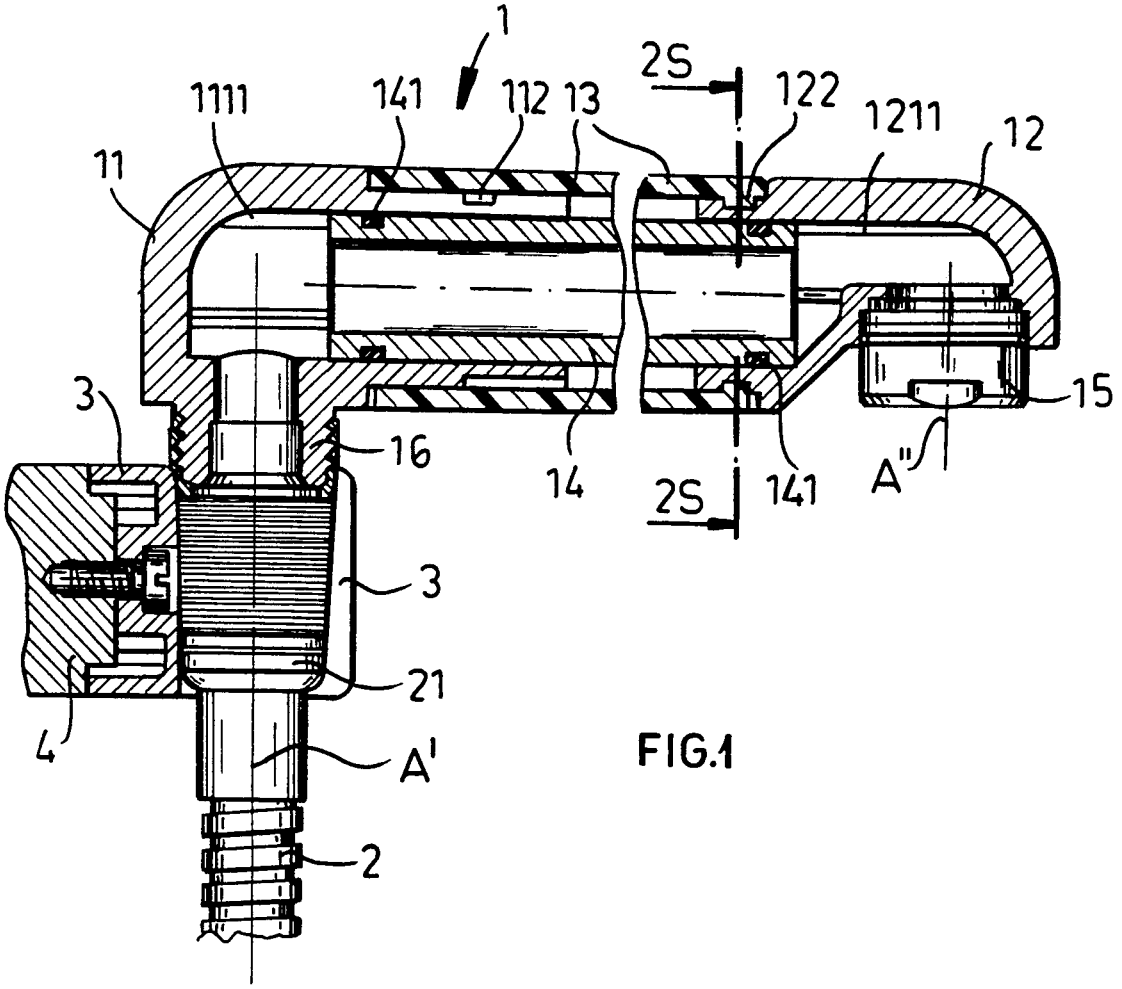
FIG. 1 is a vertical section through the plumbing fitting according to this invention.
Figure 2:
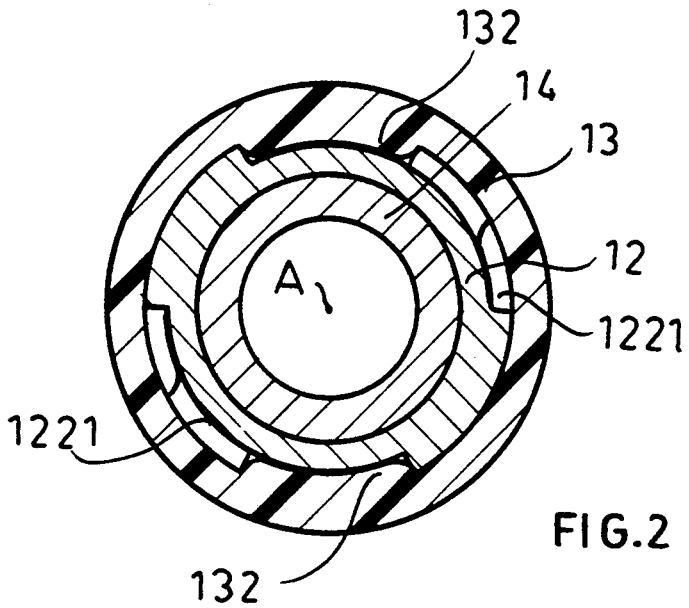
FIG. 2 is a section taken along plane 2S—2S of FIG. 1.

As seen in FIG. 1 a plumbing fitting 1 according to this invention is carried in a holder 3 itself forming part of a wall-mounted mixing valve 4 that supplies water via a hose 2 to the fitting 1. While seated in the holder 3 the fitting 1 acts as a standard faucet; when pulled therefrom it can act as a sprayer or hand shower. The fitting 1 basically is formed as an upstream end piece or elbow 11 connected to the hose 2, a downstream end piece or elbow 12 provided with an aerator 15, and an outer cover sleeve 13 and inner tube 14 interconnecting the two elbows 11 and 12.

Figure 3:
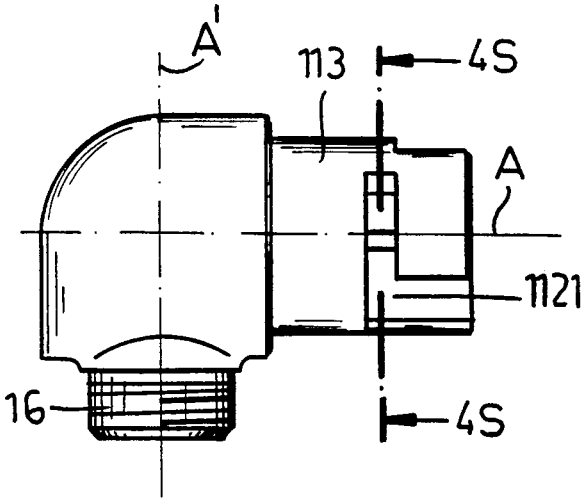
FIG. 3 is a side view of the upstream end piece.
Figure 4:
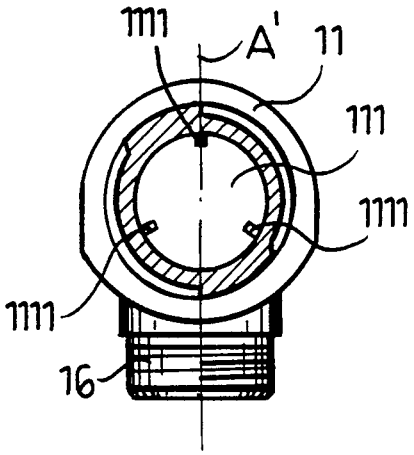
FIG. 4 is a section taken along plane 4S—4S of FIG. 3.
Figure 5:
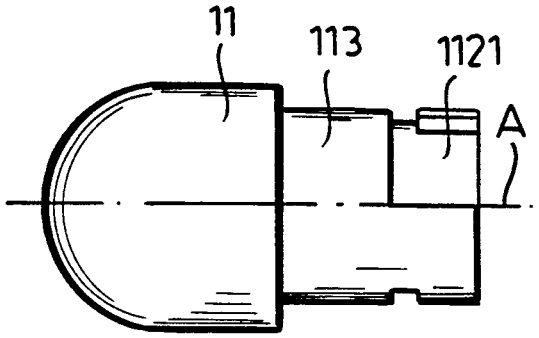
FIG. 5 is a top view of the end piece of FIG. 3.
Figure 6:
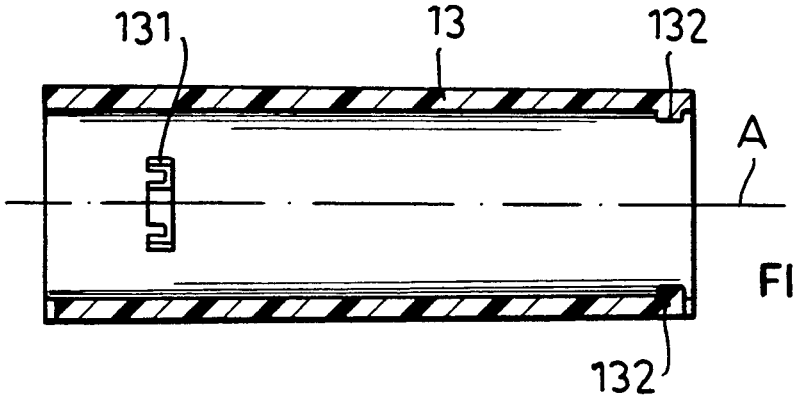
FIG. 6 is an axial section through the cover tube of this invention.

As see in more detail in FIG. 3 through 5 the upstream elbow 1 1 is formed centered on a main axis A with a long extension 113 of basically cylindrical shape internally forming a cylindrical bore 111. The upstream end of the tube 14 is complementarily engaged in this bore 111 and axially abuts ribs 1111 formed therein and acting as stops, with an 0-ring seal 141 seated in the upstream end of the tube 14 acting as seal. The upstream end of the sleeve 13 fits coaxially around the extension 113 and is formed internally (see FIG. 6) with upstream tabs 131 engaging in a J-shaped groove 1121 formed in this extension 113 and forming a bayonet-coupling 112 with the tabs 131. The upstream side of the elbow 11 is formed as a threaded nipple 16 screwed into a female fitting 21 on the free end of the hose 2 and centered on an axis A′ perpendicular to the axis A.

Figure 7:
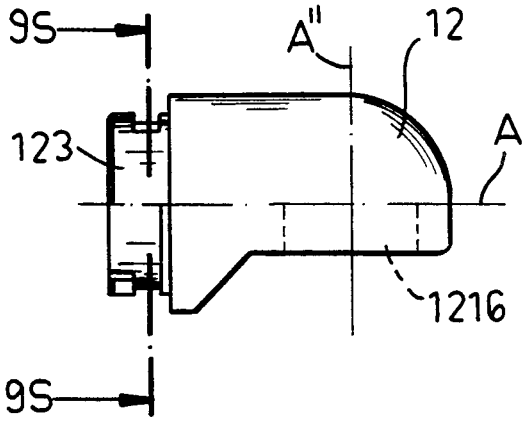
FIG. 7 is a side view of the downstream end piece.
Figure 8:
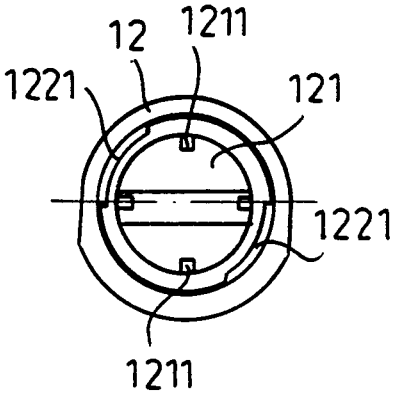
FIG. 8 is a rear end view of the end piece of FIG. 7.
Figure 9:
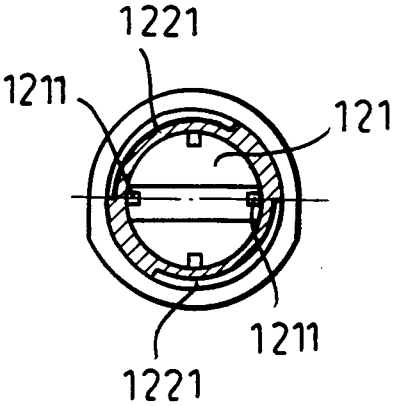
FIG. 9 is a section taken along plane 9S—9S of FIG. 7.

FIGS. 7 through 9 show the downstream elbow 12 whose upstream side is formed as a short cylindrical collar 123 internally formed with a bore 121 and ribs 1211 identical to the bore 11 and ribs 1111 of the elbow 11 and internally receiving the downstream end of the tube 14 along with its seal 141. Externally the collar 123 is formed with a J-shaped groove 1221 in which are received tabs 132 to form a downstream bayonet coupling 122 between the sleeve 13 and elbow 12. The aerator 15, which can be exchanged easily with a shower spray, is threaded into a bore 1216 formed in the downstream side of the elbow 12 and centered on an axis A″ perpendicular to the axis A and parallel to the axis A″.

According to this invention the parts 11, 12, and 14 are all made of metal. The tube 14 is made of brass and the parts 11 and 12 may be enameled or, more likely, chromium-plated. The sleeve 13 is of a durable synthetic resin and may be colored or vacuum plated with chromium. This element 13 is relatively cheap to manufacture, as it has little structural importance, so that the supplier can stock the sleeves 13 in many different colors and even in somewhat different lengths, as the axial overlap of the tube 14 with the extension 113 permits considerable variation in the overall length of the assembly. The entire fitting 1 is therefore modular so that it is relatively easy to replace any of the parts either for repair purposes, or simply for design considerations.

We claim:

1. A plumbing fitting comprising:

a flexible hose suppliable with water under pressure and having an outer end;

an upstream end piece having an upstream side connected to the outer end and a downstream side;

a downstream end piece having a downstream side and an upstream side;

an outer sleeve having an upstream end and a downstream end;

respective couplings releasably connecting the upstream end of the sleeve to the downstream side of the upstream end piece and the downstream end of the sleeve to the upstream side of the downstream end piece;

an inner tube having a downstream end connected to the upstream side of the downstream end piece and an upstream end connected to the downstream side of the upstream end piece and forming a flow conduit therebetween; and seals at the ends of the tube between same and the respective sides of the end pieces.

2. The plumbing fitting defined in claim 1 wherein the end pieces are elbows with their respective ends opening generally at right angles to each other.

3. The plumbing fitting defined in claim 2 wherein the sleeve is generally tubular and the couplings include at least one bayonet coupling.

4. The plumbing fitting defined in claim 1 wherein the tube is of metal.

5. The plumbing fitting defined in claim 4 wherein the metal is brass.

6. The plumbing fitting defined in claim 1 wherein the end pieces are elbows with their respective ends opening generally at right angles to each other and the upstream end of the upstream end piece opening in the same direction as the downstream end of the downstream end piece.

7. The plumbing fitting defined in claim 1 wherein the sleeve is of a synthetic resin.

8. The plumbing fitting defined in claim 1, further comprising:

a bracket forming a holder for the upstream end piece.

9. The plumbing fitting defined in claim 1 wherein the downstream side of the downstream end piece is provided with a aerator.

10. A plumbing fitting comprising:

a flexible hose suppliable with water under pressure and having an outer end;

an upstream elbow having an upstream side connected to the outer end and a downstream side;

a downstream elbow having a downstream side and an upstream side opening at a right angle to each other;

a flow dispenser mounted on the downstream side of the downstream elbow;

a longitudinally extending outer sleeve having an upstream end slipped over the downstream side of the upstream elbow and a downstream end slipped over the upstream side of the downstream elbow;

a coupling fixing each of the ends to the respective elbow side;

an inner tube within the sleeve and having a downstream end fitted and axially slidable in the upstream side of the downstream elbow and an upstream end fitted and axially slidable in the downstream side of the upstream end piece and forming a flow conduit therebetween, at least one of the tube ends telescoping with the respective elbow side, whereby the two elbows can move longitudinally relative to each other; and seals at the ends of the tube between same and the respective sides of the elbows.

* * * * *